United States Patent [19]

Bamburg et al.

[11] 3,979,045

[45] Sept. 7, 1976

[54] BULK MATERIAL CONTAINER

[75] Inventors: Robert A. Bamburg; Farris N. Duncan, both of West Monroe; Roger M. Floyd, Monroe, all of La.

[73] Assignee: Olinkraft, Inc., West Monroe, La.

[22] Filed: Aug. 28, 1975

[21] Appl. No.: 608,799

[52] U.S. Cl. ..... 229/23 R; 229/5.5; 229/14 BE; 229/37 R

[51] Int. Cl.[2] ..... B65D 13/04

[58] Field of Search ..... 229/5.5, 14 BA, 14 BE, 229/14 BW, 23 A, 23 R, 37 R, 37 E, 43 R, 6 R; 206/386

[56] References Cited

UNITED STATES PATENTS

| | | | |
|---|---|---|---|
| 1,591,734 | 7/1926 | Beaman | 229/23 A |
| 1,923,426 | 8/1933 | Eggerss | 229/5.5 |
| 2,665,047 | 1/1954 | Belsinger | 229/23 R |
| 2,729,384 | 1/1956 | George et al. | 229/23 R |
| 2,902,202 | 9/1959 | Fallert | 229/23 R |
| 3,124,292 | 3/1964 | Stegner | 229/37 R |
| 3,330,466 | 7/1967 | Eckles | 229/37 R |
| 3,887,125 | 6/1975 | Trentesaux | 229/14 BE |

*Primary Examiner*—William T. Dixson, Jr.
*Assistant Examiner*—Bruce H. Bernstein
*Attorney, Agent, or Firm*—Norvell E. Von Behren

[57] ABSTRACT

A paperboard bulk material container has a separate flap secured by glue, staples and the like to short flaps integral with wall panels of the container on one or both of the bottom and top ends of the container.

7 Claims, 9 Drawing Figures

FIG. 1
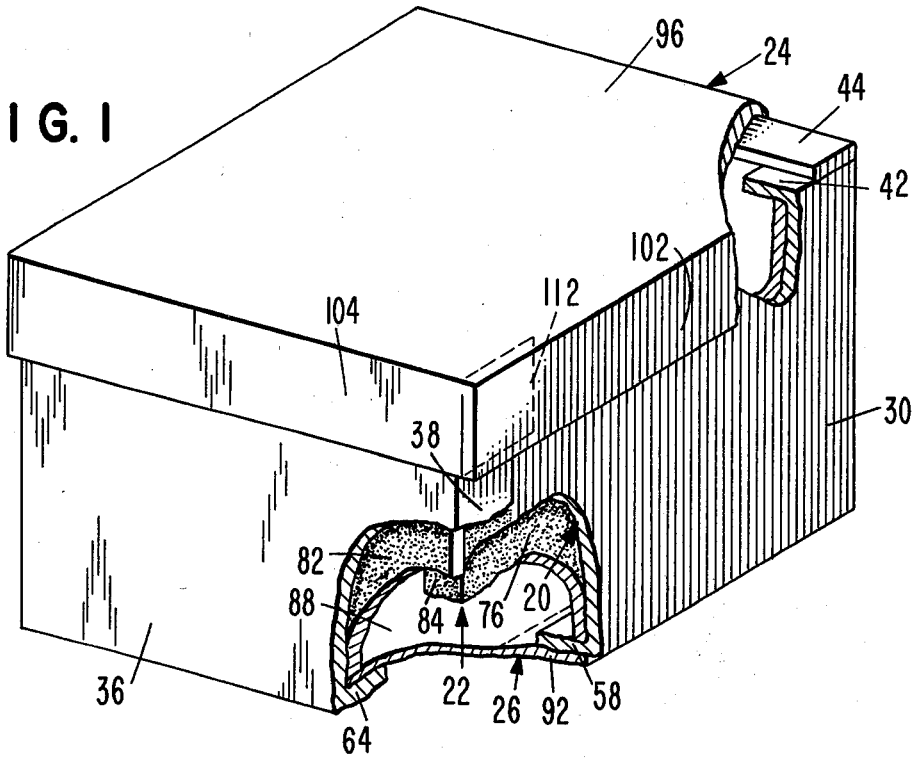
FIG. 2
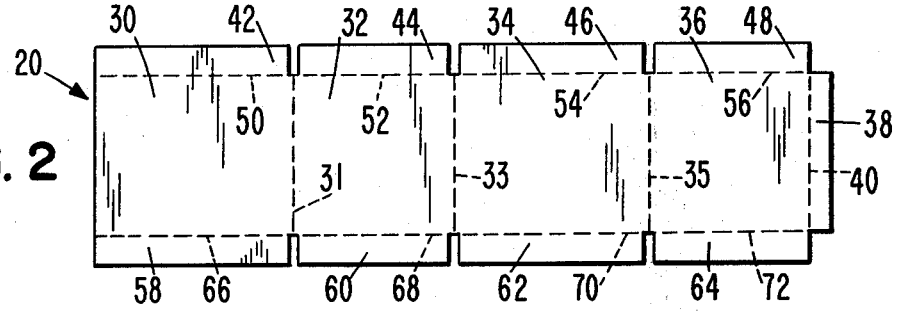
FIG. 3
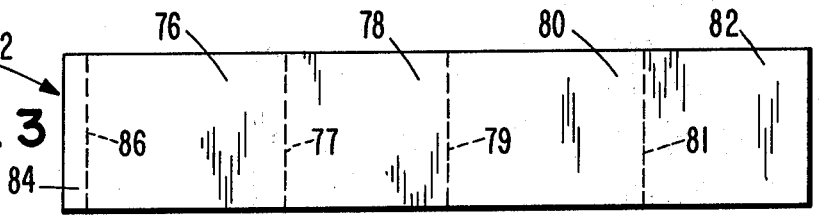
FIG. 4
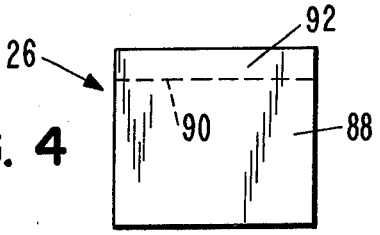
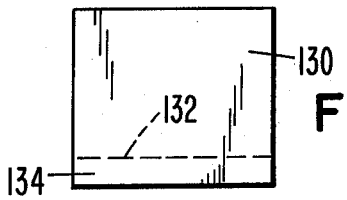
FIG. 9

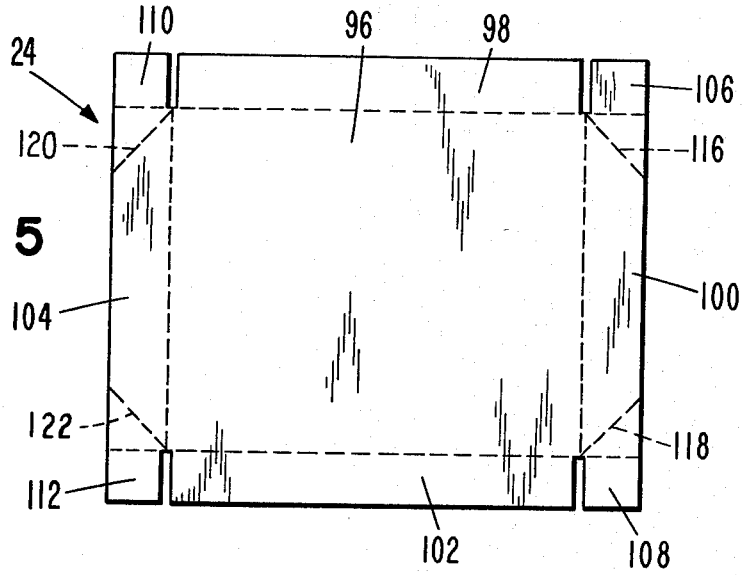
FIG. 5
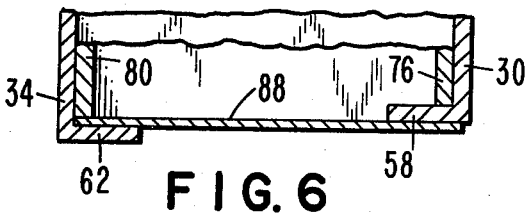
FIG. 6
FIG. 7
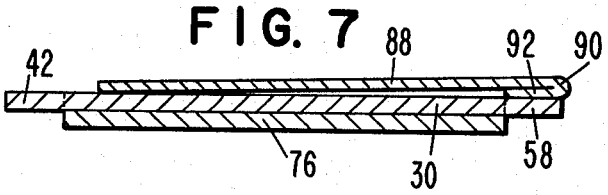
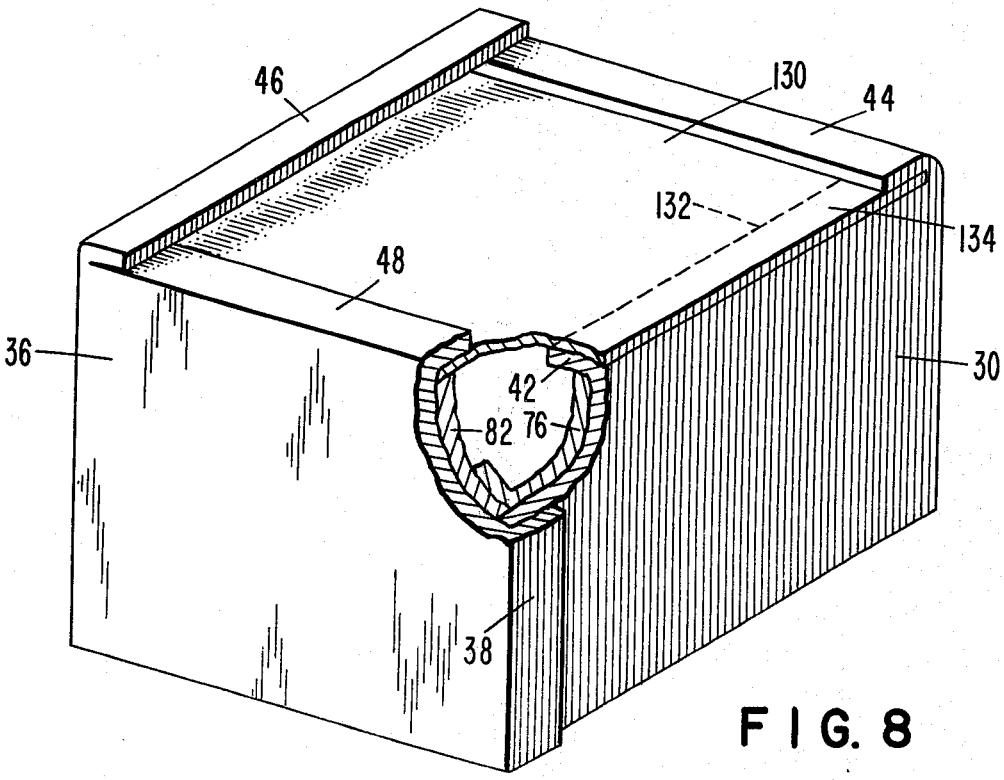
FIG. 8

BULK MATERIAL CONTAINER

BACKGROUND OF THE INVENTION

1. Field of the Invention

This invention relates to bulk material containers made from paperboard and the like, and used to transport and store granular materials such as pellets of synthetic polymer resin.

2. Description of the Prior Art

The prior art, as exemplified in U.S. Pat. No. 1,228,063, No. 1,251,769, No. 1,627,311 and No. 3,291,364, contains a number of containers including paperboard containers for shipping bulk granular material and the like. Generally bulk material containers are made completely of a relatively heavy or strong paperboard in order to withstand the forces exerted on the inside of the walls of the container.

SUMMARY OF THE INVENTION

The invention is summarized in that a bulk material container includes an integral body having side panels for forming an enclosed wall and having short flaps hinged on the edges of the side panels at one of the top and bottom ends of the body, a large flap overlapped and secured to one of the short flaps and adapted to be overlapped and secured by the other short flaps to close the one end, the large flap having a score line adjacent the edge of the one short flap opposite to the hinge on the respective side panel for allowing the large flap to be easily folded at the scoreline over the one short flap and respective side panel, and means for closing the other of the top and bottom ends of the body.

An object of the invention is to construct a bulk material container which uses less expensive material than prior bulk material containers.

Another object of the invention is to construct a bulk material container which in a folded or unassembled state takes up less area of storage or transport space.

It is also an object of the invention to provide a container which can be easily assembled from an unassembled or partially unassembled state.

An advantage of the invention is that a separate closing flap attached by glue, staples and the like to a short flap at one or more of the top and bottom ends of a container can be formed from a material which is substantially lighter in weight and less expensive than that required for the walls of the container, can be provided with an intermediate score line adjacent the edge of its attached short flap to permit folding back over the short flap and wall panel, and/or can have a size designed to engage the top edges of a liner in the container for easy assembly.

Other objects and advantages of the invention will be apparent from the following description of the preferred embodiments taken in conjunction with the accompanying drawings.

BRIEF DESCRIPTION OF THE DRAWINGS

FIG. 1 is a perspective view with portions broken away of a bulk material container in accordance with the invention.

FIG. 2 is a plan view of a blank for forming a body portion of the container of FIG. 1.

FIG. 3 is a plan view of a blank for forming a liner of the container of FIG. 1.

FIG. 4 is a plan view of a blank for forming a bottom flap for the container of FIG. 1.

FIG. 5 is a plan view of a blank for forming a top cap for the container of FIG. 1.

FIG. 6 is a cross section view of a bottom portion of the container of FIG. 1.

FIG. 7 is a cross section view of the container of FIG. 1 in an unassembled state.

FIG. 8 is a perspective view with a portion broken away of a modified container in accordance with the invention.

FIG. 9 is a plan view of a blank for forming a top flap of the modified container of FIG. 8.

DESCRIPTION OF THE PREFERRED EMBODIMENTS

As illustrated in FIG. 1 the invention is embodied in a bulk material container having a body portion indicated generally at 20, a liner indicated generally at 22, a top cap indicated generally at 24, and a bottom closing flap indicated generally at 26.

As illustrated in FIG. 2 the body portion 20 has four side or outer wall panels 30, 32, 34 and 36 serially hinged together at respective corner score lines 31, 33 and 35. A side joint flap 38 is hinged at score line 40 at the right end of the series of outer wall panels on the panel 36. Top short flaps 42, 44, 46 and 48 are hinged at score lines 50, 52, 54 and 56 defining the upper or top edges of the side panels 30, 32, 34 and 36. Similarly bottom short flaps 58, 60, 62 and 64 are hinged at score lines 66, 68, 70 and 72 defining bottom edges of the side panels 30, 32, 34 and 36.

The liner 22 shown in FIG. 3 includes side or inner wall panels 76, 78, 80 and 82 serially hinged together at respective score lines 77, 79 and 81. A joint flap 84 is hinged at score line 86 to the left end of the series of liner panels on end panel 76. The panels 76, 78, 80 and 82 are designed to be bonded such as by glue to the inside surfaces of the outer wall panels 30, 32, 34 and 36.

The bottom flap, FIG. 4, is formed as a separate rectangular panel 88 which has a score line 90 thereacross forming a side portion 92 of the panel 88 which corresponds to the width of the bottom short panel 58. The dimensions of the panel 88 are selected such that when the container is assembled as shown in FIG. 1, the edge portions of the panel engage the bottom edges of the liner panels 78, 80 and 82 while freely fitting inside the walls formed by panels 30, 32, 34 and 36.

As illustrated in FIG. 5, the top cap has a rectangular top panel 96 with short side panels 98, 100, 102 and 104 hinged at respective score lines to each of the four edges of the top panel 96. Joint flaps 106 and 108 are hinged at opposite end edges of the panel 100 while joint flaps 110 and 112 are hinged on opposite end edges of the panel 104. Score lines 116 and 118 formed at forty five degree angles with the longitudinal dimension of the panel 100 extend from the respective right hand corners of the panel 96 across the side panel 100 to the bottom edge of the panel 100, and score lines 120 and 122 extend from the respective left hand corners of the panel 96 across the short side panel 104 to the bottom longitudinal edge of the panel 104 at a forty five degree angle. The score lines 116, 118, 120 and 122 are such as to provide fold lines allowing the cap 24 to be folded flat when the joint flaps 106, 108, 110 and 112 have been overlapped and secured with the respective opposite ends of the panels 98 and 102.

The body portion 20 and the liner 22 are made from a heavyweight or relatively strong corrugated paperboard having single, double or triple laminated layers of corrugations, or the like, while the bottom panel 88 is made from a relatively lightweight paperboard or the like, for example the bottom portion 20 and the liner 22 can be made from a high strength corrugated paperboard having a 500 pound per square inch bursting strength rating in accordance with the Uniform Freight Classification Test while the bottom panel 88 is made from a lesser strength corrugated paperboard having a 275 pound per square inch bursting strength rating. Also the top cap 24 can be formed from a lesser strength material such as a corrugated paperboard or the like having a 350 pound per square inch bursting strength. Since the strength of the paperboard is directly dependent on the weight (i.e. the weight or amount of material per unit area) and the thickness of the paperboard sheet or panel, the body portion 20 and the liner 22 are formed from a paperboard having a substantially greater weight and thickness than the weight and thickness of the bottom panel 88 or the top cap 24.

When the container is assembled as shown in FIG. 1, the inner wall panels 76, 78, 80 and 82 of the liner 22 are laminated with the outer wall panels 30, 32, 34, and 36, respectively, of the body portion 20 by glue or the like as indicated by the stipling. The side portion 92 of the bottom panel 88 is attached to the short bottom flap 58 by glue, staples, or the like. Then the joined wall panels and the joint flaps of the body 20 and liner 22 can be bent at score lines 31, 33, 35, 40, 77, 79, 81 and 86 with the joint flap 38 overlapping the outer surface of the panel 30 and secured thereto by glue, staples, or the like, and with the joint panel 84 overlapping the inner surface of the panel 82 and joined thereto by glue, staples or the like.

The panel 88 and the short flap 58 are folded inward until the edges of the panel 88 engage the bottom edges of the liner panels 78, 80 and 82 to square up the walls on the container as well as accurately position the panel 88. The other short flaps 60, 62 and 64 are suitably folded to overlap the edges of the bottom panel 88 and attached thereto by glue, staples or the like.

The top cap is assembled in a conventional manner by folding the panels 98, 100, 102 and 104 downward and overlapping and securing the panels 98 and 102 over the top cap joining flaps 110, 106, 108, and 112 respectively to form a top cap which telescopes over the upper end of the outer wall of the body portion 20. The short flaps 42, 44, 46, and 48 of the body portion 20 can be bent inward beneath the top cap 24 prior to assembly of the top cap 24 on the container.

A substantially less expensive container is made possible by forming the bottom panel 88 and top cap 24 from a separate paperboard material having substantially less weight than the body portion 20 and by making the short flaps 58, 60, 62 and 64 only sufficiently wide to secure the panel 88. Since the bottom of bulk material containers are supported by pallets or skids, only the walls of the container have to be sufficiently strong to withstand the pressure of the bulk material. It is only necessary for the panel 88 and its bond to the short flaps 58, 60, 62 and 64 to be strong enough to withstand the tension forces from the pressure on the walls. Since the cost of the paperboard and its shipping expense is directly dependent upon its relative weight, a substantial savings in cost is made by using the lesser weight material in the panel 88.

Prior to the use of the container, it may be folded flat in a partially assembled position for shipment and storage of the container. As shown in FIG. 7, the bottom panel 88 may be bent at hinge 90 and folded back over the short bottom flap 58 and the side panel 30 to produce a flat folded container occupying less area than if the panel 88 were not folded back. The lesser thickness or heaviness of the panel 88 results in substantially lesser uneveness in stacking the partially assembled and folded flat containers than if the panel 88 were made from the same weight of paperboard as the body 20 and the liner 22.

In a modification of the container as illustrated in FIG. 8 parts are identified by the same numbers used to identify parts in FIGS. 1–7 indicating that such parts are substantially the same in structure and/or function. In the modification the top cap of FIGS. 1–5 is replaced by a top panel 130, shown in FIG. 9, which similar to the bottom panel 88 has a score line 132 defining a portion 134 of the panel 130 corresponding to the short top flap 42. The panel 88 has rectangular dimensions designed to fit within the outside walls 30, 32, 34 and 36 but to engage the upper edges of the inside liner walls 76, 78, 80 and 82. In assembly the portion 134 is attached to the short top flap 42 by glue, staples and the like. The top panel 130 and the short top flap 42 are bent inward until the outside edges of the top panel 130 engage the upper edges of the liner panels 78, 80 and 82 whereupon the other short top panels 44, 46 and 48 are bent inward overlapping the outer edges of the panel 130 and are suitably attached thereto by glue, staples or the like. Similar to the bottom panel 88 the top panel 130 is made of a lightweight material such as a 275 pound per square inch rated material, thus resulting in a less costly container. During shipment and storage of the container of FIG. 8 in a partially assembled and folded flat state, the panel 130 may be bent at the score line 32 to fold the panel 130 over the short top flap 42 and outer wall panel 30 to occupy less area.

Since many modifications, variations and changes in detail may be made to the presently described embodiments, it is intended that all matter in the foregoing description and shown in the accompanying drawings be interpreted as illustrative and not in a limiting sense.

What is claimed is:

1. A bulk material container comprising an integral body having side panels for forming an enclosed wall and having short flaps hinged on the edges of the side panels at one of the top and bottom ends of the body, a large flap overlapped and secured to one of the short flaps and adapted to be overlapped and secured to the other short flaps to close the one end, said integral body formed of a paperboard having a first weight, said large flaps formed of a paperboard having a second weight, said first weight being substantially greater than said second weight, means for closing the other of the top and bottom ends of the body, and said large flap having a fold line adjacent the edge of the one short flap opposite to the hinge on the respective side panel for allowing the large flap to be folded over the one short flap and respective side panel.

2. A bulk material container as claimed in claim 1 including a liner having panels secured to the inside surface of the respective side panels of the body, said liner having top edges and bottom edges adjacent the top and bottom edges of the body panels, said large flap having dimensions selected to engage edge portions of the large flap against the edges of the liner panels adjacent the one end of the body.

3. A bulk material container as claimed in claim 1 wherein the one end is the bottom end of the body.

4. A bulk material container as claimed in claim 3 wherein said means for closing the other end of the body includes second short flaps hinged on the edges of the side panels at the top end of the body, a second large flap overlapped and secured to one of the second short flaps and adapted to be overlapped and secured by the other second short flaps to close the top end, said second large flap formed of a paperboard having a third weight which is substantially less than said first weight.

5. A bulk material container comprising an integral body having side panels for forming an enclosed wall and having short flaps on the edges of the side panels at one of the top and bottom ends of the body, a large flap overlapped and secured to one of the short flaps and adapted to be overlapped and secured to the other short flaps to close the one end, said large flap having a score line adjacent the edge of the one short flap opposite to the hinge on the respective side panel for allowing the large flap to be easily folded at the score line over the one short flap and respective side panel, and means for closing the other of the top and bottom ends of the body.

6. A bulk material container as claimed in claim 5 including a liner having panels secured to the inside surfaces of the respective side panels of the body, said liner panels having top and bottom edges adjacent the top and bottom edges of the body panels, said large flap having dimensions selected to engage edges portions of the large flap against the edges of the liner panels adjacent the one end of the body.

7. A bulk material container comprising an integral body having four serially hinged side panels, a side joint flap hinged on the end of one of the body side panels, four top short flaps hinged on the top edges of the respective body side panels, and four bottom short flaps hinged on the bottom edges of the respective body side panels;

a liner having four serially hinged side panels glued to inside surfaces of the respective body side panels, and a side joint flap hinged on the end of one of the liner side panels opposite the body side joint flap;

a rectangular large flap overlapped and glued to one of the bottom short flaps and having dimensions to engage the bottom edges of the liner within the body;

said body and liner formed of a paperboard having a first weight;

said large flap formed of a paperboard having a second weight, said first weight being substantially greater than said second weight, said other bottom short flaps adapted for overlapping and securing the rectangular large flap;

said large flap having a score line adjacent the edge of the one bottom short flap opposite the hinge of the one bottom short flap for being folded over the one bottom short flap and respective body side panel; and means for closing the top of the body.

* * * * *